US007909653B1

(12) United States Patent
Wan et al.

(10) Patent No.: US 7,909,653 B1
(45) Date of Patent: Mar. 22, 2011

(54) HIGH-SPEED PLUG CONNECTOR WITH A MOUNTING BRACKET HOLDING TERMINALS

(75) Inventors: Wei Wan, Hsin-Tien (TW); Shu-Lin Duan, Hsin-Tien (TW); Ching-Tien Chen, Hsin-Tien (TW); Pin-Yuan Hou, Hsin-Tien (TW); Wen-Chih Ko, Hsin-Tien (TW)

(73) Assignee: Advanced Connectek Inc., Hsin-Tien (TW)

( * ) Notice: Subject to any disclaimer, the term of this patent is extended or adjusted under 35 U.S.C. 154(b) by 0 days.

(21) Appl. No.: 12/591,863

(22) Filed: Dec. 3, 2009

(30) Foreign Application Priority Data

Sep. 18, 2009 (TW) ..... 98131520 A

(51) Int. Cl.
*H01R 24/00* (2006.01)

(52) U.S. Cl. ..... 439/660

(58) Field of Classification Search ..... 439/660, 439/607.01, 607.11, 607.41, 108, 101
See application file for complete search history.

(56) References Cited

U.S. PATENT DOCUMENTS

| | | | | |
|---|---|---|---|---|
| 6,050,850 | A * | 4/2000 | Crane et al. | 439/569 |
| 6,146,157 | A * | 11/2000 | Lenoir et al. | 439/101 |
| 7,670,156 | B2 * | 3/2010 | Chen | 439/108 |
| 7,736,184 | B1 * | 6/2010 | Wan et al. | 439/607.11 |
| 7,744,382 | B2 * | 6/2010 | Zheng et al. | 439/79 |
| 2009/0042450 | A1 * | 2/2009 | Zheng et al. | 439/660 |
| 2009/0258539 | A1 * | 10/2009 | Zheng et al. | 439/607.41 |
| 2010/0136830 | A1 * | 6/2010 | Chen et al. | 439/607.01 |
| 2010/0137583 | A1 * | 6/2010 | Babine et al. | 544/101 |
| 2010/0159745 | A1 * | 6/2010 | Wan et al. | 439/607.11 |

* cited by examiner

*Primary Examiner* — Chandrika Prasad
(74) *Attorney, Agent, or Firm* — Bacon & Thomas, PLLC

(57) ABSTRACT

A high-speed plug connector has an insulating housing, a mounting bracket, multiple first terminals, multiple second terminals and a shell. The first terminals are mounted on the insulating housing. The second terminals are mounted on the mounting bracket. Each terminal has a mounting section, a soldering section and a contacting section. The soldering sections are arranged in a transverse row instead of two rows to make the high-speed plug connector compact and reduce mounting surface areas of a PCB on which the soldering sections is soldered.

13 Claims, 10 Drawing Sheets

HIGH-SPEED PLUG CONNECTOR WITH A MOUNTING BRACKET HOLDING TERMINALS

BACKGROUND OF THE INVENTION

1. Field of the Invention

The present invention relates to a connector, and more particularly to a high-speed plug connector that appropriately arranges soldering sections of terminals thereof to effectively reduce mounting surface areas of a printed circuit board (PCB) on which the soldering sections are soldered.

2. Description of Related Art

Conventional Universal Serial Bus (USB) 2.0 connectors are popularly used in various electronic devices. However, USB 2.0 protocol only allows a maximum transmission speed of 480 Mbps. Because electronic devices are constantly developed to increase transmission speeds, the USB 2.0 protocol does not meet current transmission speed requirement of new electronic devices. Therefore, the USB Implementers Forum (USB IF) established USB 3.0 protocol, with a theoretical maximum transmission speed of 5 Gbps.

However, a USB 3.0 connector having two rows of terminals is structurally complicated so that manufacturing a USB 3.0 connector is difficult. Due to the rows of terminals and other constraints USB 3.0 connectors are generally longer and broader than USB 2.0 connectors. Furthermore, the terminals of the USB 3.0 connector generate crosstalk and interfere with each other when transmitting high frequency signals. Moreover, two rows of soldering sections of the terminals, when soldered on a PCB, occupy more surface area of the PCB when compared to a conventional connector. Therefore, the USB 3.0 connector has a low production rate and a high manufacturing cost.

To overcome the shortcomings, the present invention provides a high-speed plug connector to mitigate or obviate the aforementioned problems.

SUMMARY OF THE INVENTION

The main objective of the invention is to provide a high-speed plug connector that appropriately arranges soldering sections of terminals thereof to effectively reduce mounting surface areas of a printed circuit board (PCB) on which the soldering sections are soldered.

A high-speed plug connector in accordance with the present invention has an insulating housing, a mounting bracket, multiple first terminals, multiple second terminals and a shell. The first terminals are mounted on the insulating housing. The second terminals are mounted on the mounting bracket. Each terminal has a mounting section, a soldering section and a contacting section. The soldering sections are arranged in a transverse row instead of two rows to make the high-speed plug connector compact and reduce mounting surface areas of a PCB on which the soldering sections is soldered.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
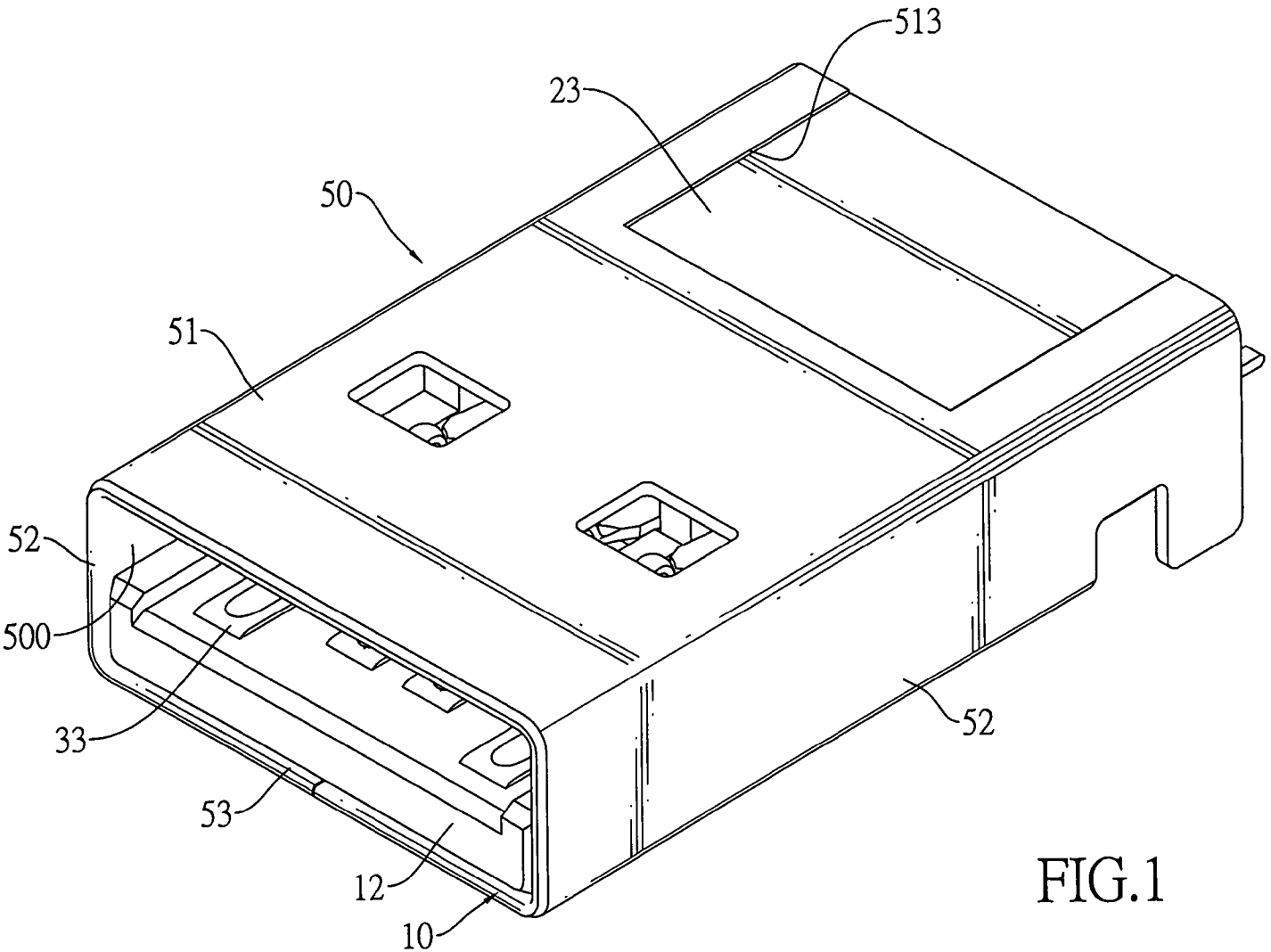
FIG. 1 is a perspective view of a first embodiment of a high-speed plug connector in accordance with the present invention.
Figure 2:
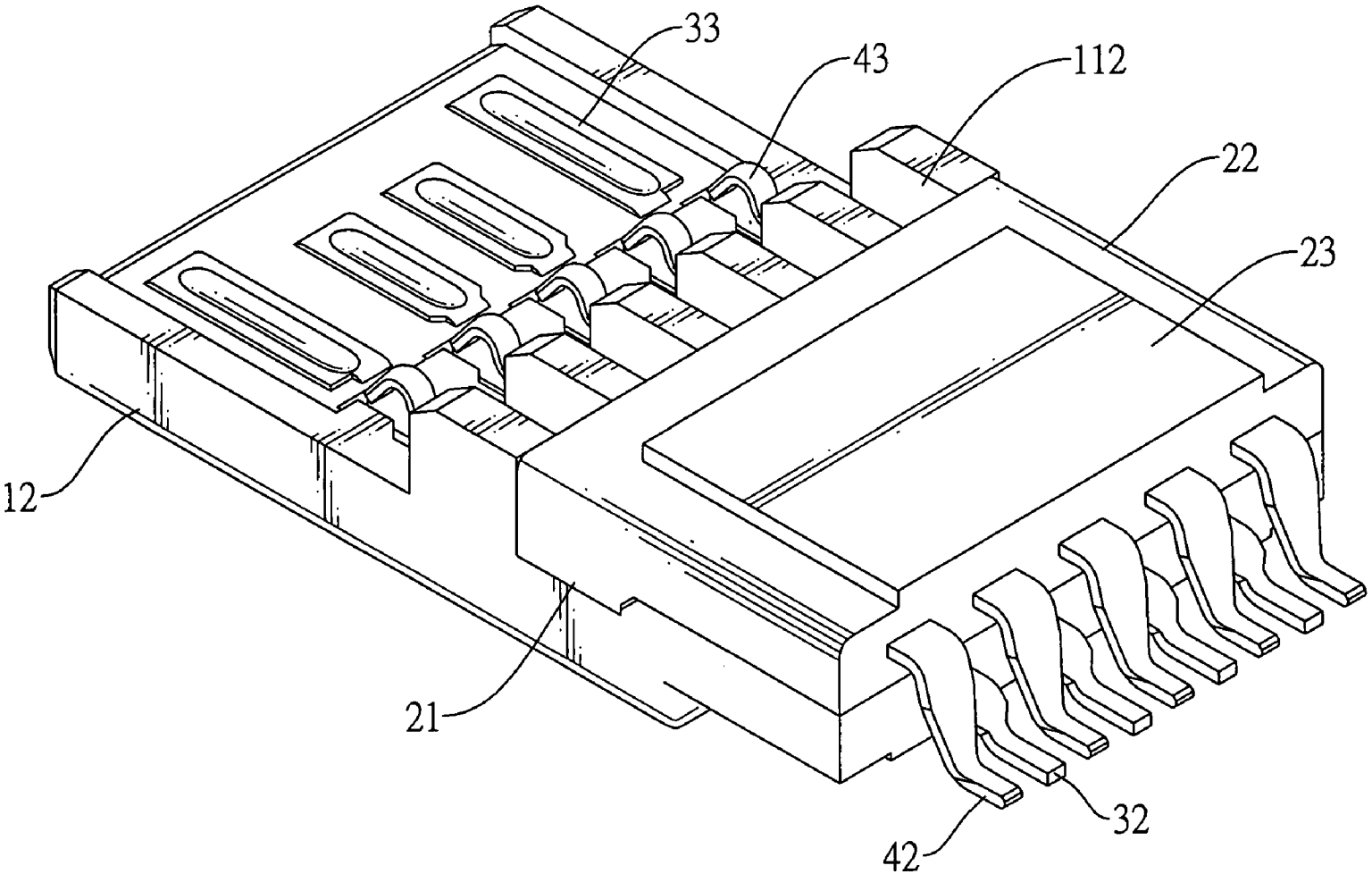
FIG. 2 is a perspective view of the high-speed plug connector in FIG. 1 omitting the shell.
Figure 3:
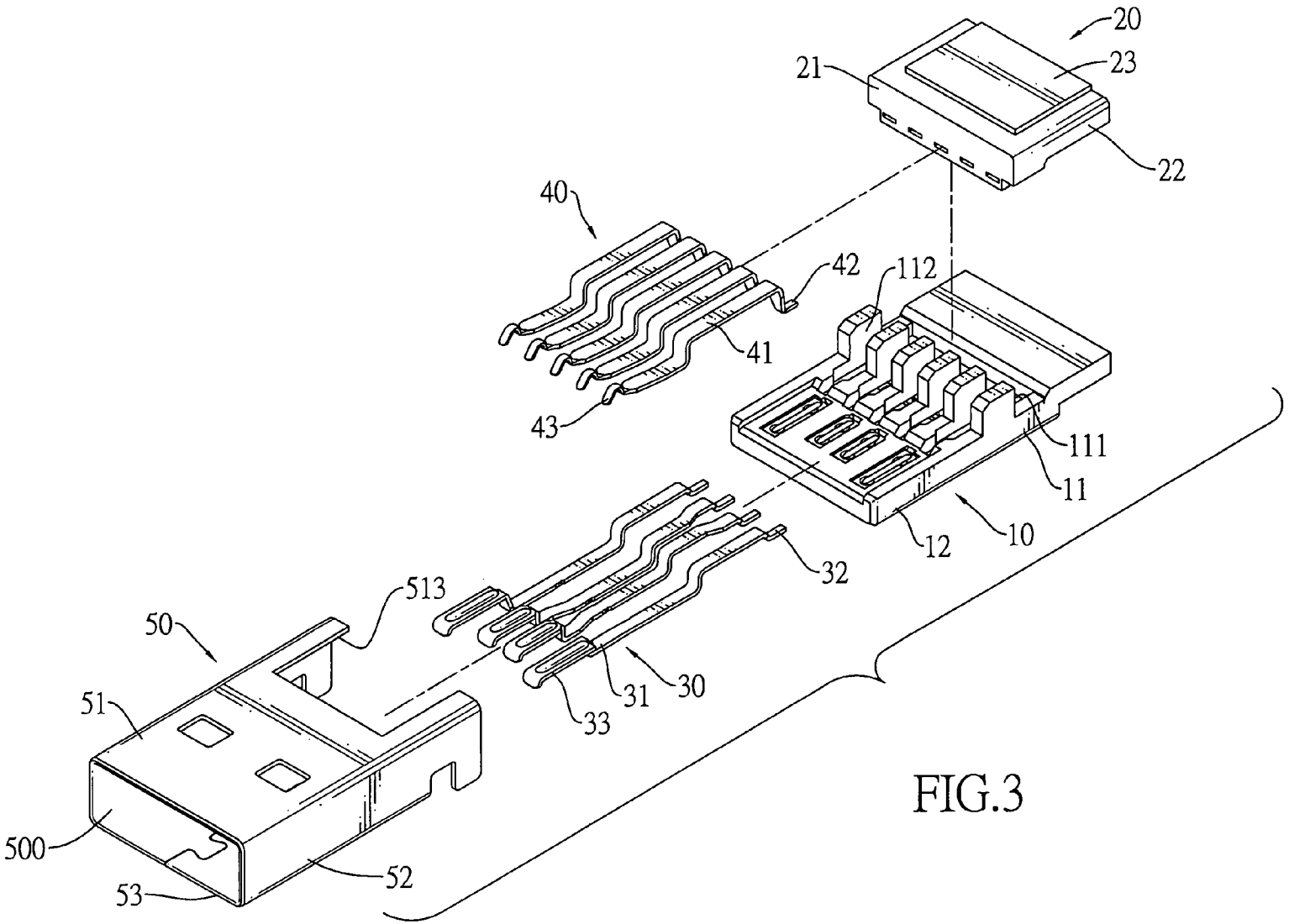
FIG. 3 is an exploded front perspective view of the high-speed plug connector in FIG. 1.
Figure 4:
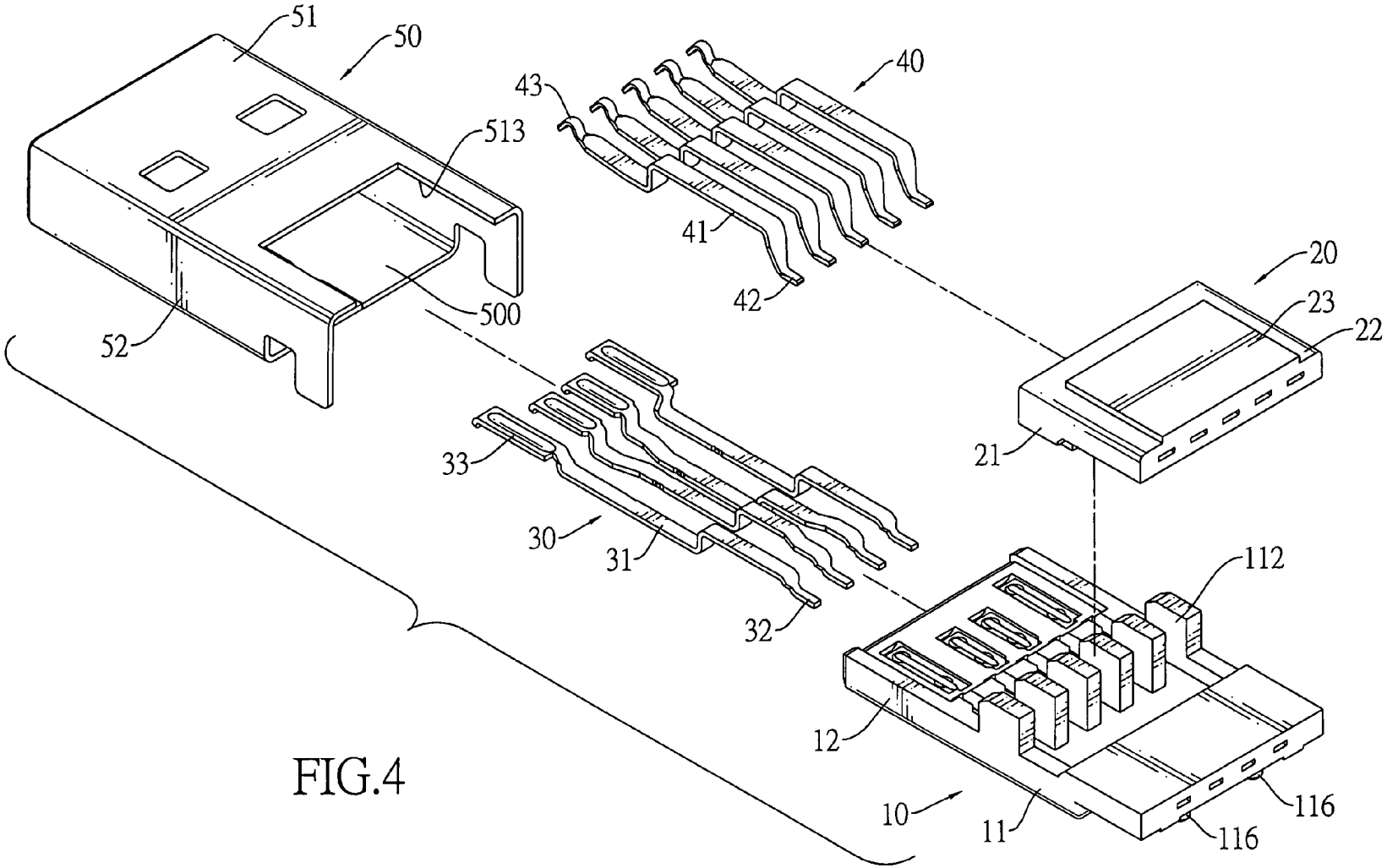
FIG. 4 is an exploded rear perspective view of the high-speed plug connector in FIG. 1.

With reference to FIGS. 1 to 4, a first embodiment of a high-speed plug connector accordance with the present invention may comply with type-A USB 3.0 plug connector standards and may be mounted on one end of a cable or in a portable device such as a flash memory storage device.

The high-speed plug connector of the first embodiment is a surface mount technology (SMT) type high-speed plug connector and comprises an insulating housing (10), a mounting bracket (20), multiple first terminals (30), multiple second terminals (40) and a shell (50).

Figure 5:
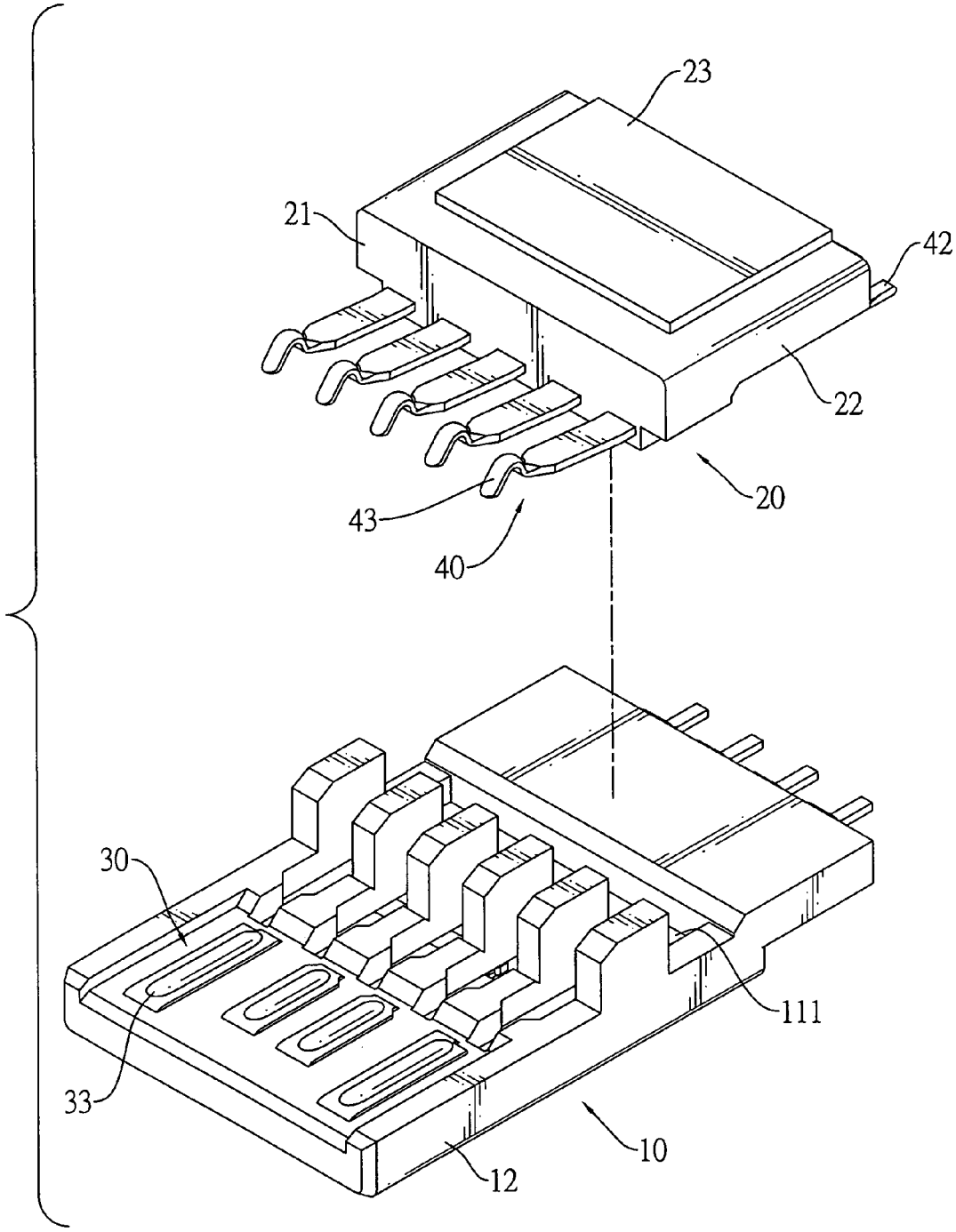
FIG. 5 is a partial exploded perspective view of an insulating housing and a mounting bracket of the high-speed plug connector in FIG. 1.

With further reference to FIG. 5, the insulating housing (10) has a front end, a rear end, a base (11) and a tongue (12).

The base (11) has a front end, a rear end, a top and a bottom and may further have a fastening slot (111), multiple positioning grooves (112) and multiple assembling protrusions (116). The fastening slot (111) is defined in the base (11). The positioning grooves (112) are defined in the top of the base (11). The assembling protrusions (116) are formed on and protrude downward from the bottom of the base (11) and may be mounted through assembling holes in a PCB or a bracket in the aforementioned cable or portable device.

The tongue (12) is formed on and protrudes forward from the front end of the base (11) and has a top and a bottom.

The mounting bracket (20) is a separate component from the insulating housing (10), is mounted on the insulating housing (10) and has a mount (21) and an extension member (22).

The mount (21) may be mounted in the fastening slot (111) of the insulating housing (10).

The extension member (22) is formed on and protrudes backward from the mount (21) and may have a top surface, a bottom surface, a rear end and a mounting protrusion (23). The mounting protrusion (23) is formed on and protrudes from the top surface.

The first terminals (30) are mounted through the insulating housing (10) by an insert-molding process and are capable of implementing USB 2.0 signal transmission. Each first terminal (30) has a mounting section (31), a soldering section (32) and a contacting section (33).

The mounting section (31) is mounted securely in the insulating housing (10).

The soldering section (32) is formed on and protrudes downward from the mounting section (31) and out of the rear end of the base (11).

The contacting section (33) is formed on and protrudes forward from the mounting section (31) and may be mounted on the top of the tongue (12).

The second terminals (40) are mounted through the mounting bracket (20) by an insert-molding process, are capable of cooperating with the first terminals (30) to implement USB 3.0 signal transmission and may be mounted respectively in the positioning grooves (112) to prevent inadvertent transverse shift. Each second terminal (40) has a mounting section (41), a soldering section (42) and a contacting section (43).

The mounting section (41) is mounted securely in the mounting bracket (20).

The soldering section (42) is formed on and protrudes downward from the mounting section (42) and out of the rear end of the extension member (22).

The contacting section (43) is formed on and protrudes forward from the soldering section (42) and is located above the tongue (12) of the insulating housing (10).

The shell (50) covers the insulating housing (10), the mounting bracket (20), the first terminals (30) and the second terminals (40), has a cavity (500) and may further have a front end, a rear end, a top plate (51), two side plates (52), a bottom plate (53) and an open slot (513).

The cavity (500) is defined through the shell (50) and may hold a tongue of a corresponding socket connector.

The top plate (51) has a rear end.

The side plates (52) are formed on and protrude downward from the top plate (51).

The bottom plate (53) is formed between the side plates (52).

The open slot (513) is defined in the top plate (51) adjacent to the rear end and holds the mounting protrusion (23) of the mounting bracket (20).

In one of important aspects of the present invention, the soldering sections (32) of the first terminals (30) and the soldering sections (42) of the second terminals (40) are arranged alternately in a transverse row relative to the insulating housing (10). Furthermore, the first and second terminals (30) include multiple pairs of signal-transmission-terminals and multiple non-signal-transmission terminals (such as power terminals and grounding terminals). The soldering section (32, 42) of one of the non-signal-transmission terminals is located between the soldering sections (32, 42) of the signal-transmission-terminals of each pair.

In a preferred embodiment of the high-speed plug connector, the first terminals (30) are numbered as No. 5, 6, 7, 8 and 9 terminals (5, 6, 7, 8, 9) that are defined respectively as a super-speed negative signal receiving terminals (the aforementioned signal-transmission-terminal), a super-speed positive signal receiving terminal (the aforementioned signal-transmission-terminal), a signal-return-grounding terminal (the aforementioned non-signal-transmission terminal), a super-speed negative signal transmitting terminal (the aforementioned signal-transmission-terminal) and a super-speed positive signal transmitting terminal (the aforementioned signal-transmission-terminal).

The second terminals (40) are numbered as No. 4, 3, 2 and 1 terminals (4, 3, 2, 1) that are defined respectively as a power-return-grounding terminal (the aforementioned non-signal-transmission terminal), a positive signal terminal (the aforementioned signal-transmission terminal), a negative signal terminal (the aforementioned signal-transmission terminal) and a power terminal (the aforementioned non-signal-transmission terminal). The soldering sections (32, 42) of all of the first and second terminals (30, 40) in the transverse row are arranged according to a sequence of No. 5, 4, 6, 3, 7, 2, 8, 1 and 9 terminals (5, 4, 6, 3, 7, 2, 8, 1, 9) from a left side to a right side of the high-speed plug connector.

The following Table A is based on Section 5.3.1.2 of "USB 3.0 Specification, Revision 1.0" set forth by the USB IF. The Specification may be downloaded from the USB IF website: http://www.usb.org/home.

TABLE A

High-speed Plug Connector Terminal Assignment

| Terminal Number | Name | Assignment |
|---|---|---|
| No. 5 terminal (5) | StdA_SSRx− | Super-speed negative signal receiving terminal |
| No. 4 terminal (4) | GND | Power-return-grounding terminal |
| No. 6 terminal (6) | StdA_SSRx+ | Super-speed positive signal receiving terminal |
| No. 3 terminal (3) | D+ | Positive signal terminal |
| No. 7 terminal (7) | GND_DRAIN | Signal return-grounding terminal |
| No. 2 terminal (2) | D− | Negative signal terminal |
| No. 8 terminal (8) | StdA_SSTx− | Super-speed negative signal transmitting terminal |
| No. 1 terminal (1) | VBUS | Power terminal |
| No. 9 terminal (9) | StdA_Tx+ | Super-speed positive signal transmitting terminal |

The definitions of the aforementioned first and second terminals (30, 40) are shown in Table A for clarity and convenience.

Figure 6A:
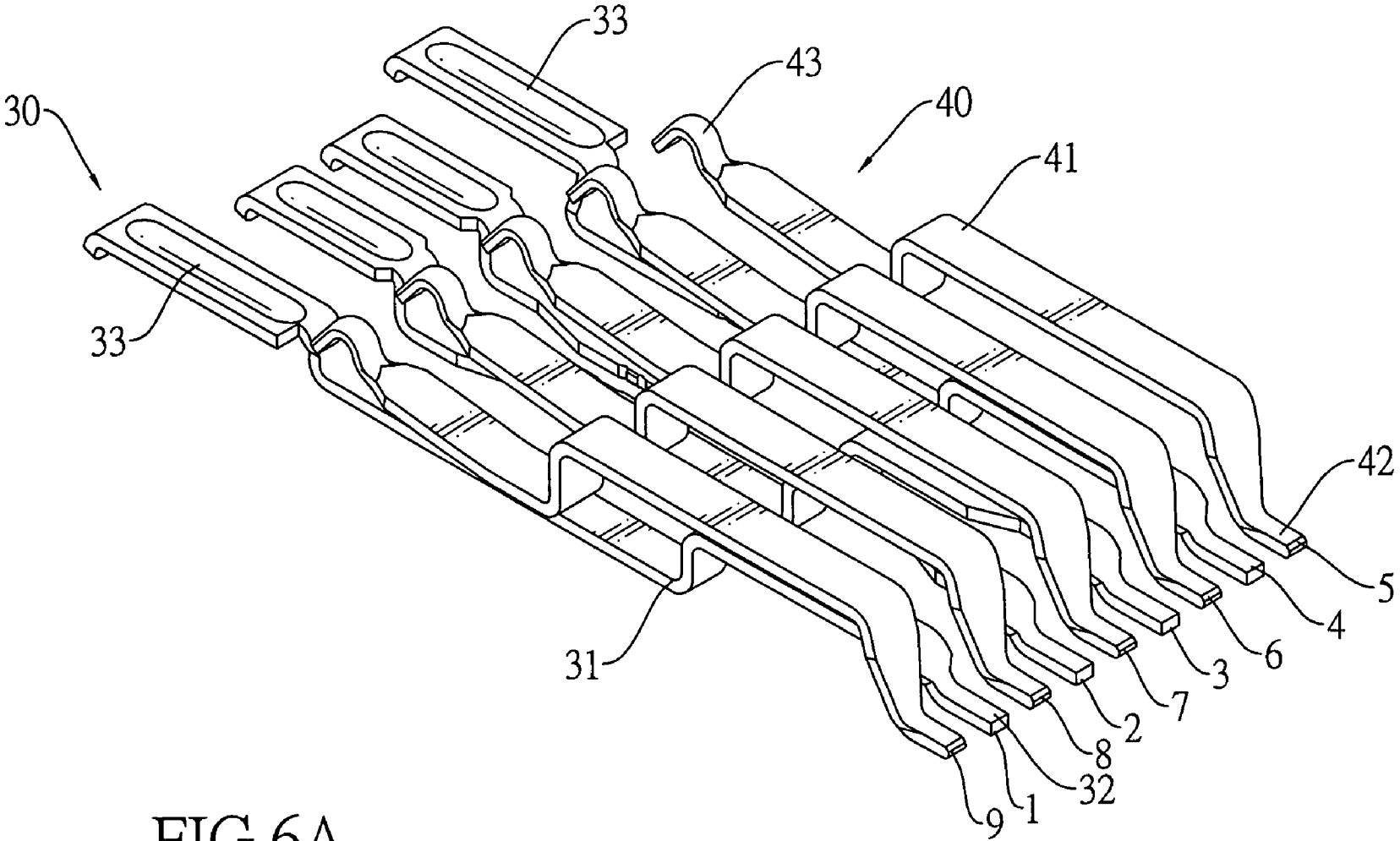
FIG. 6A is a perspective of first and second terminals of the high-speed plug connector in FIG. 1.
Figure 7:
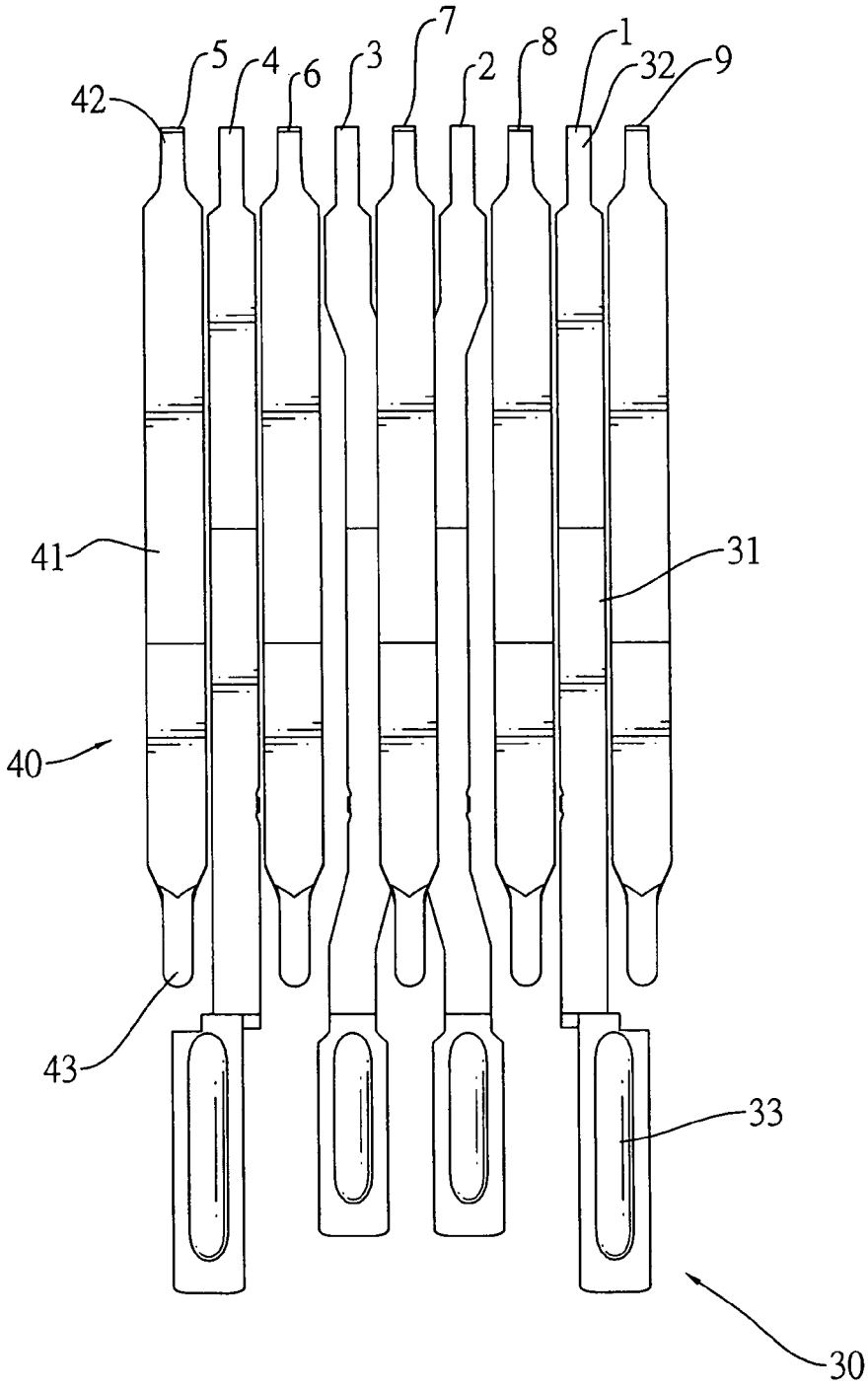
FIG. 7 is a top view of the first and second terminals of the high-speed plug connector in FIG. 6A.

With reference to FIGS. 6A and 7, in the first embodiment, the soldering sections (32, 42) of the first and second terminals (30, 40) are SMT type soldering sections and are L-shaped.

Figure 6B:
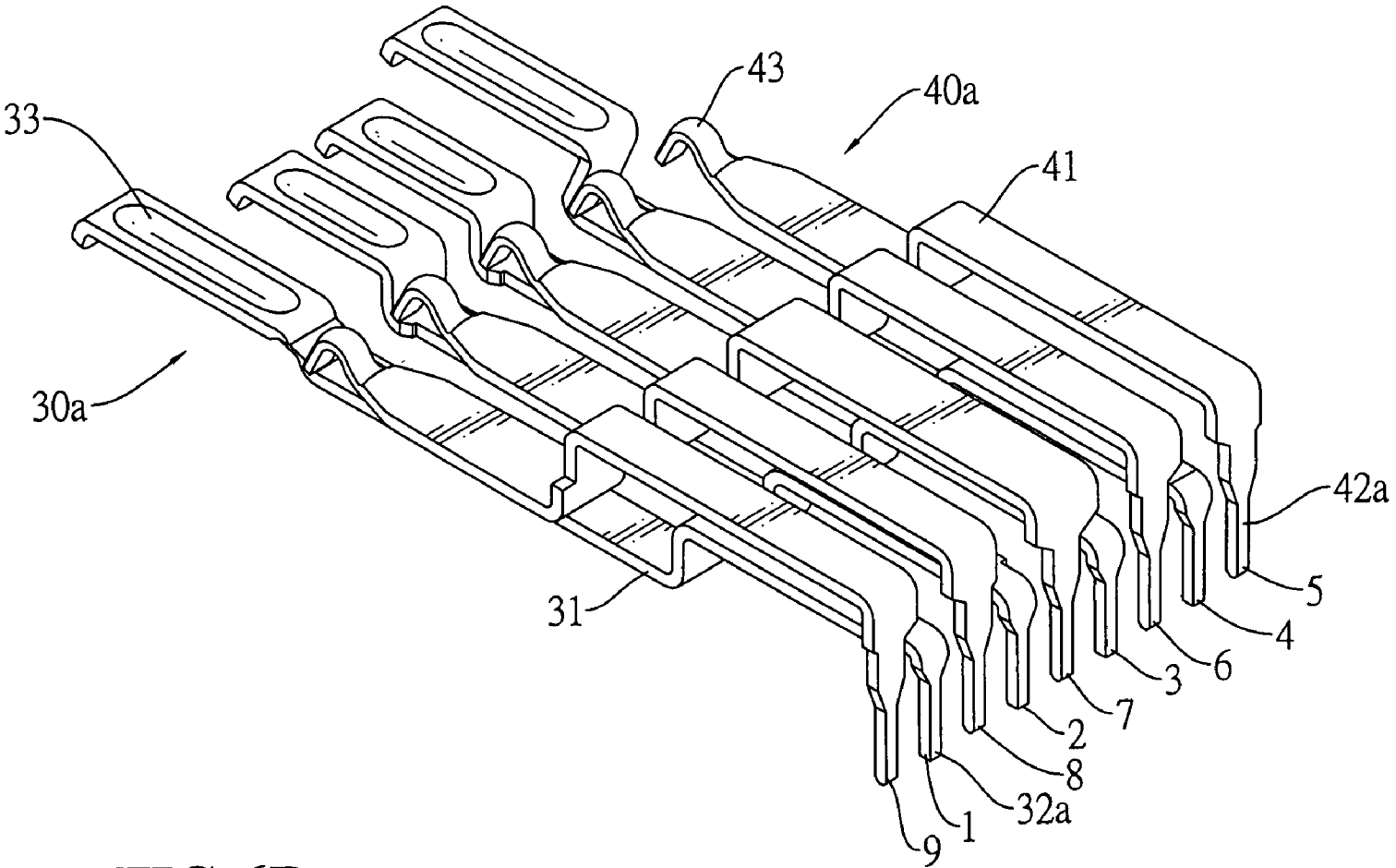
FIG. 6B is a perspective view of first and second terminals of a second embodiment of a high-speed plug connector in accordance with the present invention.

With reference to FIG. 6B, a second embodiment of the high-speed plug connector is a through hole technology (THE) type high-speed plug connector. Therefore, the soldering sections (32*a*, 42*a*) of the first and second terminals (30*a*, 40*a*) are THE type soldering sections and are straight.

Figure 8A:
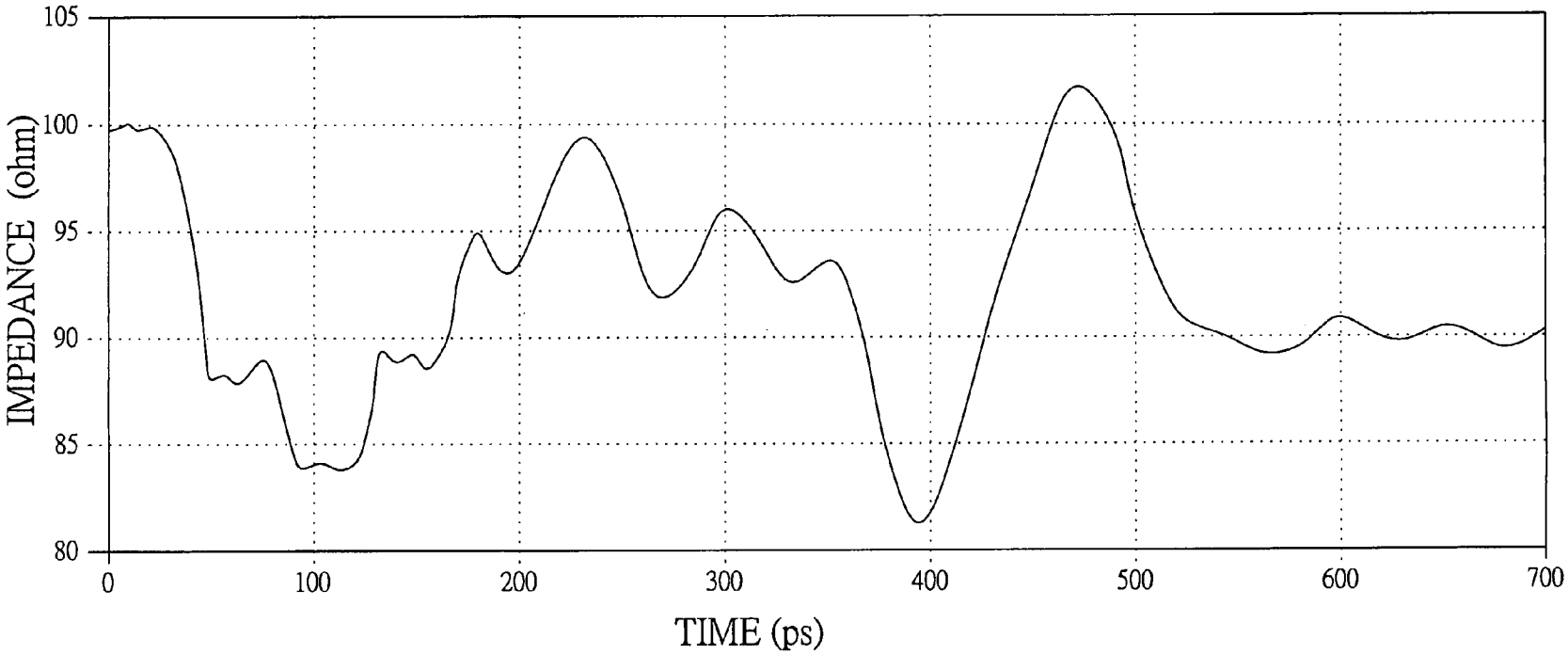
FIG. 8A is a plot of impedance against time for the first embodiment of the high-speed plug connector in FIG. 1.

With further reference to FIG. 8A, a diagram of impedance against time shows a curve indicating impedance of the SMT type high-speed plug connector of the first embodiment during signal transmission. The unit of the impedance is "ohm" and that of the time is "$10^{-12}$ second (Pico-second, ps)". As indicated by the curve, when signal transmission is implemented, maximum and minimum impedance values of the SMT type high-speed plug connector are 101.7 and 81.25 ohm and are within a limitation from 75 to 105 ohms of a standard USB 3.0 plug connector. Therefore, advantages of the SMT type high-speed plug connector include high frequency signal transmission.

Figure 8B:
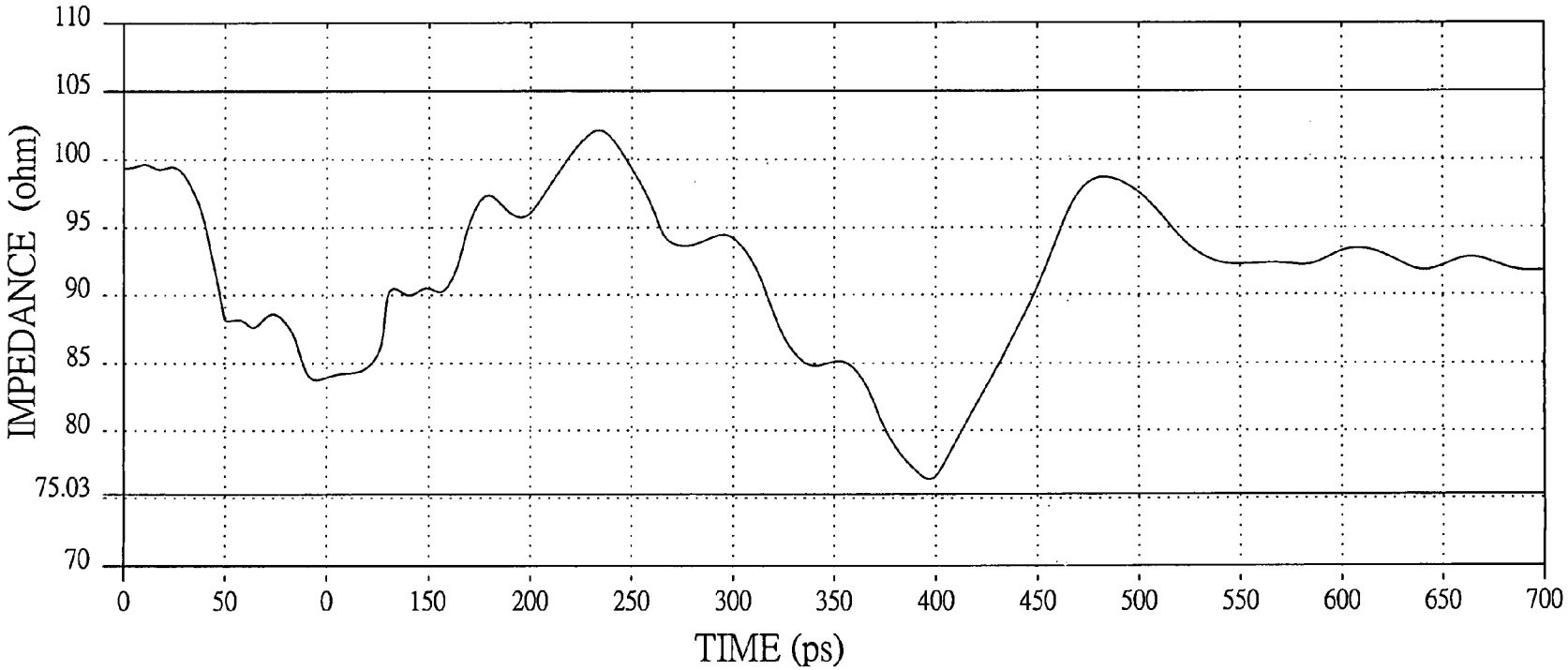
FIG. 8B is a plot of impedance against time for the second embodiment of the high-speed plug connector in FIG. 6B.

With further reference to FIG. 8B, a diagram of impedance against time shows a curve indicating impedance of the THE type high-speed plug connector of the second embodiment during signal transmission. As indicated by the curve, when signal transmission is implemented, maximum and minimum impedance values of the THE type high-speed plug connector are 101.9 and 76.5 ohm and are within the aforementioned standard limitation from 75 to 105 ohms. Therefore, advantages of the THE type high-speed plug connector include high frequency signal transmission.

The present invention has the following advantages:

1. The soldering sections (32, 32*a*, 42, 42*a*) of the first and second terminals (30, 30*a*, 40, 40*a*) are disposed alternately in a single row so that total length and size of the high-speed plug connector are reduced. Furthermore, a soldering section layout thereof is compact to effectively reduce mounting surface areas of a PCB on which the soldering sections (32, 32*a*, 42, 42*a*) are soldered. Therefore, the PCB still holds electronic components such resistors and capacitors according to its original PCB layout. In other words, the PCB would not need to change the PCB layout for mounting the high-speed plug connector thereon.

2. The soldering sections (32, 32*a*, 42, 42*a*) of the non-signal-transmission terminals such as No. 4, 7, 1 terminals (4, 7, 1) are located respectively between of the soldering sections (32, 32*a*, 42, 42*a*) of the pairs of the signal transmitting or receiving terminals (2, 3, 5, 6, 8, 9) such as No. 5, 6, 3, 2, 8, 1 terminals (5, 6, 3, 2, 8, 1) to prevent crosstalk and improve signal transmission stability.

3. The insulating housing (10) and mounting bracket (20) are separate components instead of being formed together so that designing and manufacturing a mold for each component is easy and cheap when compared to a structurally complicated mold for molding an one-piece insulating housing holding all terminals of a conventional connector. Thus, manufacturing costs of the high-speed plug connector are lowered.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A high-speed plug connector, comprising:

an insulating housing having a front end and a rear end;

a mounting bracket being a separate component relative to the insulating housing and mounted on the insulating housing;

multiple first terminals mounted through the insulating housing and each first terminal having a mounting section mounted securely in the insulating housing;

a soldering section formed on and protruding from the mounting section out of the rear end of the insulating housing; and a contacting section formed on and protruding from the mounting section;

multiple second terminals mounted through the mounting bracket and not on the insulating housing and each second terminal having a mounting section mounted securely in the mounting bracket;

a soldering section formed on and protruding from the mounting section; and a contacting section formed on and protruding from the soldering section; and a shell covering the insulating housing, the mounting bracket, the first terminals and the second terminals and having a cavity defined through the shell, wherein the soldering sections of the first terminals and the soldering sections of the second terminals are arranged alternately in a transverse row relative to the insulating housing.

2. The high-speed plug connector as claimed in claim 1, wherein the first and second terminals include multiple pairs of signal-transmission terminals and multiple non-signal-transmission terminals; and the soldering section of one of the non-signal-transmission terminals is located between the soldering sections of the signal-transmission terminals of each pair.

3. The high-speed plug connector as claimed in claim 2, wherein the first terminals are numbered as No. 5, 6, 7, 8 and 9 terminals that are defined respectively as a super-speed negative signal receiving terminal, a super-speed positive signal receiving terminal, a signal-return-grounding terminal, a super-speed negative signal transmitting terminal and a super-speed positive signal transmitting terminal;

the second terminals are numbered as No. 4, 3, 2 and 1 terminals that are defined respectively as a power-return-grounding terminal, a positive signal terminal, a negative signal terminal and a power terminal; and the soldering sections of all terminals in the transverse row are arranged according to a sequence of the No. 5, 4, 6, 3, 7, 2, 8, 1 and 9 terminals from one side to another side of the high-speed plug connector.

4. The high-speed plug connector as claimed in claim 3, wherein the high-speed plug connector complies with type-A USB 3.0 plug connector standards;

the first terminals are capable of implementing USB 2.0 signal transmission; and the second terminals are capable of cooperating with the first terminals for implementing USB 3.0 signal transmission.

5. The high-speed plug connector as claimed in claim 2, wherein the insulating housing further has a base having a front end, a rear end, a top and a bottom; and a tongue formed on and protruding forward from the front end of the base and having a top and a bottom;

the mounting bracket has a mount; and an extension member formed on and protruding backward from the mount and having a top surface, a bottom surface and a rear end;

the soldering sections of the first terminals protrude out of the rear end of the base and the contacting sections of the first terminals are mounted on the top of the tongue; and the soldering sections of the second terminals protrude out of the rear end of the extension member and the contacting sections of the second terminals are located above of the tongue of the insulating housing.

6. The high-speed plug connector as claimed in claim 5, wherein the base of the insulating housing further has a fastening slot defined in the base; and the mount of the mounting bracket is mounted in the fastening slot.

7. The high-speed plug connector as claimed in claim 5, wherein the extension member of the mounting bracket further has a mounting protrusion formed on and protruding from the top surface of the extension member; and the shell further has a front end, a rear end, a top plate, two side plates, a bottom plate and an open slot defined in the top plate adjacent to the rear end and holding the mounting protrusion.

8. The high-speed plug connector as claimed in claim 3, wherein the soldering sections of the first and second terminals are surface mount technology (SMT) type soldering sections and are L-shaped.

9. The high-speed plug connector as claimed in claim 3, wherein the soldering sections of the first and second terminals are through hole technology (THE) type soldering sections and are straight.

10. The high-speed plug connector as claimed in claim 5, wherein the base of the insulating housing further has multiple assembling protrusions formed on and protruding downward form the bottom.

11. The high-speed plug connector as claimed in claim 5, wherein the first terminals are mounted on the insulating housing by an insert-molding process.

12. The high-speed plug connector as claimed in claim 5, wherein second terminals are mounted on the mounting bracket by an insert-molding process.

13. The high-speed plug connector as claimed in claim 1, wherein the mounting bracket is stacked and mounted on a top of the insulating housing.

* * * * *

UNITED STATES PATENT AND TRADEMARK OFFICE

CERTIFICATE OF CORRECTION

PATENT NO. : 7,909,653 B1
APPLICATION NO. : 12/591863
DATED : March 22, 2011
INVENTOR(S) : Wei Wan et al.

It is certified that error appears in the above-identified patent and that said Letters Patent is hereby corrected as shown below:

Please correct item (73) on the Title page of the patent, the assignee from:
"Advanced Connectek Inc., Hsin-Tien (TW)"
to
"Advanced-Connectek Inc., Hsin-Tien (TW)"

In the Specification:
Col. 3, lines 48-50 replace:
-In a preferred embodiment of the high-speed plug connector, the first terminals (30) are numbered as No. 5, 6, 7, 8 and 9 terminals (5, 6, 7, 8, 9)-
with the following:
-In a preferred embodiment of the high-speed plug connector, the first terminals (30) are numbered as No. 4, 3, 2, 1 terminals (4, 3, 2, 1)-

Col. 3, lines 60-61 replace:
-The second terminals (40) are numbered as No. 4, 3, 2 and 1 terminals (4, 3, 2,1 )-
with the following:
-The second terminals (40) are numbered as No. 5, 6, 7, 8 and 9 terminals (5, 6, 7, 8, 9)-

In the Claims:
Col. 6, line 3 replace:
-the first terminals are numbered as No. 5, 6, 7, 8 and 9-
with the following:
-the first terminals are numbered as No. 4, 3, 2, and 1-

Col. 6, line 10 replace:
-the second terminals are numbered as No. 4, 3, 2 and 1-
with the following:
-the second terminals are numbered as No. 5, 6, 7, 8 and 9-

Signed and Sealed this
Twentieth Day of August, 2013

Teresa Stanek Rea
*Acting Director of the United States Patent and Trademark Office*